United States Patent [19]

Faltin

[11] 4,448,408

[45] May 15, 1984

[54] GRIPPER CLAMPS FOR CONVEYING PAPER SHEET PRODUCTS

[75] Inventor: Hans G. Faltin, York, Pa.

[73] Assignee: Advance Enterprises, Inc., York, Pa.

[21] Appl. No.: 333,428

[22] Filed: Dec. 22, 1981

Related U.S. Application Data

[63] Continuation-in-part of Ser. No. 271,032, Jun. 4, 1981.

[51] Int. Cl.[3] ..... B65H 5/02

[52] U.S. Cl. ..... 271/277; 271/204

[58] Field of Search ..... 271/277, 204, 206

[56] References Cited

U.S. PATENT DOCUMENTS

| | | | |
|---|---|---|---|
| 3,977,673 | 8/1976 | Seto | 271/277 |
| 4,039,182 | 8/1977 | Reist | 271/204 X |
| 4,381,056 | 4/1983 | Eberle | 271/204 X |

*Primary Examiner*—Richard A. Schacher
*Attorney, Agent, or Firm*—Laurence R. Brown

[57] ABSTRACT

A gripper tractor assembly is provided for selectively grasping, conveying and releasing newspapers and like products in a high speed transit path between processing stations. Its structure comprises two jaws pivotable about a common pivot pin for movement between open and closed jaw positions by means of a cammed lever assembly and equipped with rollers for engaging a transport tract defining its travel path. Alignment of the products is assured by a pair of separated stops against which the paper is positioned and gripping means centered therebetween. The papers are gripped by a rubber-like O-ring mounted on an arm extending from the gripping edge of one jaw as the edge is abutted against the stops in self-aligning fashion. The tractors are positioned at precise spacing along a link chain for movement therewith. Removable attachment means for the carriage includes an L-shaped chain link, which permits removable bolt coupling of the carriages to the link chain for eash maintenance and installation. To avoid stresses tending to release the clamping action of the jaw or to misalign paper products during transport, the jaws hold the papers against a platform surface holding the papers at an angle to the transport axis in natural position for shingling to avoid bending or stresses.

6 Claims, 5 Drawing Figures

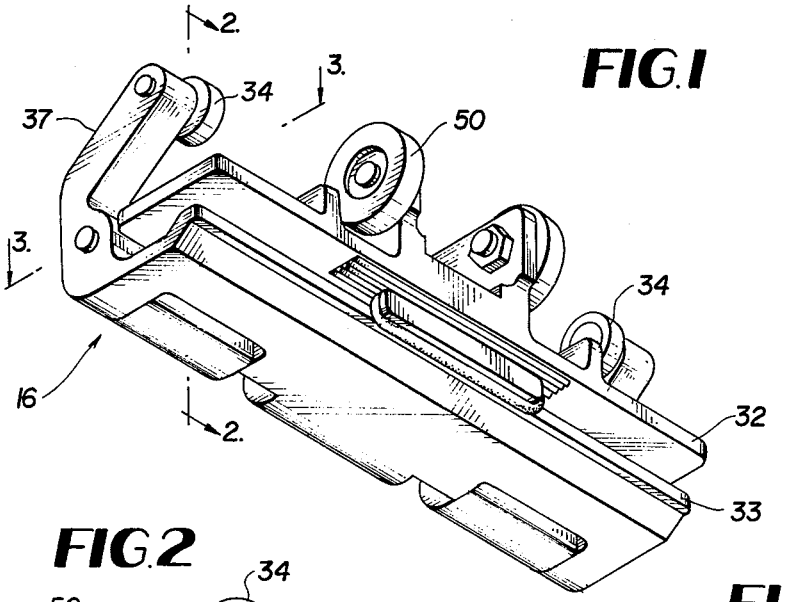
FIG. 1
FIG. 2
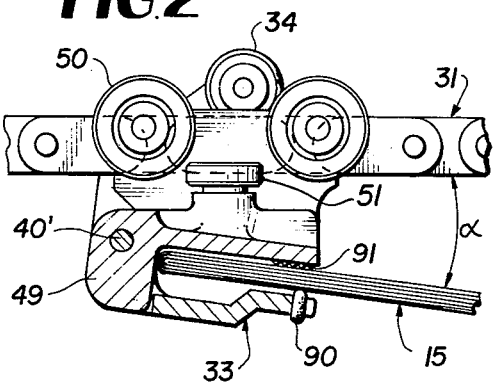
FIG. 4
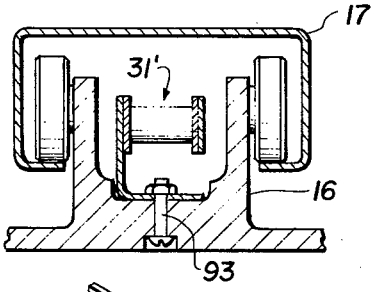
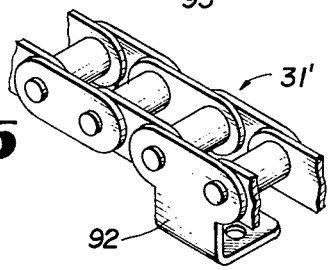
FIG. 5
FIG. 3
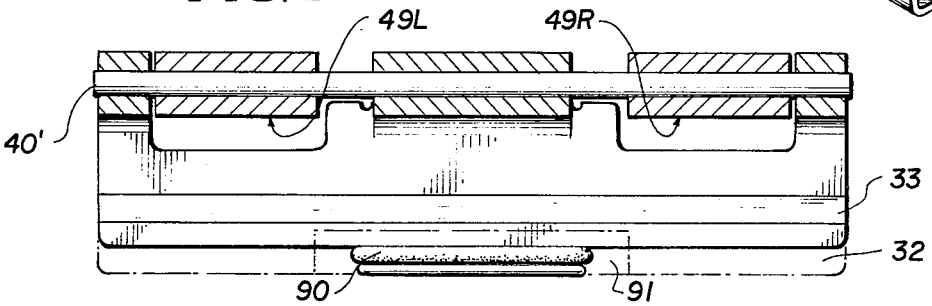

GRIPPER CLAMPS FOR CONVEYING PAPER SHEET PRODUCTS

This invention is a continuation-in-part of the copending application Ser. No. 271,032 of the inventor filed June 4, 1981 for "High Speed Transport System for Newspaper and the Like".

TECHNICAL FIELD

This invention relates to conveyance of paper sheet products such as newspapers from station to station in a processing system and more particularly it relates to an improved paper gripper clamp tractor assembly that moves in a sequence of assemblies over a conveyor track path to hold the paper sheet products in shingled array.

BACKGROUND ART

That parent application discloses a conveyor system for transporting newspapers or like sheet paper products from station to station in a processing plant at high speeds. It provides a transport system including a channel track in which rides a spaced sequence of tractor assemblies that grip, hold and release the individual paper products at precise synchronous timing to various work process stations for such operations as addressing, stacking, counting, etc. This continuation-in-part application relates to improved transport tractor assembly structure.

Prior to the parent application, endless conveyors with spaced gripping elements were proposed in U.S. Pat. No. 3,955,667—E. Muller et al., May 11, 1976. In that type of prior art various problems exist in the transport tractor assemblies.

For example, in any system requiring precise timing or alignment, the clamps, jaws or grippers must hold each paper in a precise spacing relationship without variations and in exact alignment. After a paper is gripped and in the clamp assembly, it is possible to change timing and alignment if there are gravity stressed placed on the papers by hanging and when bends or unnatural shapes are forced in the papers by the clamp mechanism. Any rotary motion components possible in the clamp or paper can either misalign the paper or require it to be fed critically in exact balanced center position. Thus, the prior art has not produced a clamping tractor transport assembly for paper products that satisfactorily meets the precision timing and alignment criteria for feeding a paper at high speeds into a sequence of processing stations. Thus, any advantages gained in transport would be lost by the necessity to provide realignment or retiming equipment at various processing stations in a system.

Thus, it is an objective of this invention to provide improved high speed gripper clamp transport assemblies for conveying paper sheet products along a track between various processing stations of a system, which resolves the foregoing problems and provides other features, solutions and advantages found throughout the following description, the drawings and the claims.

DISCLOSURE OF THE INVENTION

Thus, there is provided by this invention, improved gripping clamp tractor assemblies for high speed conveyance of newspapers and like paper products along a designated path defined by a track for picking up and releasing the products in precise orientation, spacing and timing thereby for synchronous operation with cooperating processing equipment such as presses, addresses, counters, inserters, etc.

A preferred embodiment of the clamp assembly comprises a pair of pivoted jaws coming together at a gripper edge for selectively gripping, holding and releasing the newspaper at selected station sites alongside the conveyor track. Each jaw is preferably a molded plastic member which interleaves with the mating jaw member. The two jaw members are held together as a unit by a common pivot pin. One jaw has wheel bearing means mounted thereon for engaging the transport track and the other a pivot arm for moving it between open and closed gripping positions in accordance with a selected program by means of a mating cam, for example.

The tractors are carried by a link chain at precisely spaced distances designated by selected chain links. A special L-shaped chain link arm is coupled to the tractor by bolts for ready removal or attachment of the tractor for use, servicing and replacement, etc.

Special features include a slanted platform for holding gripped papers in natural shingled posture to prevent forces on the gripper jaws that could misalign the papers during transport, pick-up or release. Also, alignment stops are spaced at the ends of the longitudinally shaped gripper jaws with gripper clamp means centered therebetween. This permits self-aligning action and reduces the possibility of entering, gripping and transporting the paper in misalignment at an angle.

Improved gripper structure includes a friction surface on one jaw mating with a replaceable rubber-like O ring stretched over a T-shaped extension arm on the other jaw gripper edge.

BRIEF DESCRIPTION OF DRAWINGS

In the drawing

FIG. 1 is a perspective view of a clamp transport assembly afforded by this invention;

FIG. 2 is a partial end view partly in section taken along lines 2—2 of FIG. 1 of the clamp showing a paper gripped therein;

FIG. 3 is a rear view partly in section and partly in phantom taken along lines 2—2 of FIG. 1;

FIG. 4 is a partial section view along the track axis of a clamp riding in a track with its transporting chain link attachment; and FIG. 5 is a segmental view in perspective of the transporting link chain assembly afforded by this invention.

THE PREFERRED EMBODIMENT

The tractor transport assembly 16 as shown in FIG. 1 rides in a track 17 wherein the single piece U-shaped channel mouth has inwardly directed flanges as shown in FIG. 4 and is moved by means of a link chain 31' over a cyclic path in a system for processing newspapers, for example, as described in the parent application, which is incorporated in its entirety by reference herein. The carriage and its special features as claimed herein are described fully in the preferred embodiments shown in FIGS. 1 to 5.

Rollers 50 comprising outer track wheels ride as confined within U-shaped channel track 17 to seat in the track and assembly 16 as conveyed by the chain 31' by means of the special L-shaped link 92 which is removably bolted to the carriage by means of a pair of bolts 93. Thus, several carriages are spaced along the link chain and separated an exact distance apart for the purpose of carrying papers 15 in shingled fashion. Support wheel 51 rides on the channel 17 as shown in more detail in the parent case.

The paper 15 is gripped by the jaws 32 and 33 respectively with friction ridge surface 91 and the O-ring 90 located on the gripping edges of the jaws. The O-ring 90, made of rubber or the like, is stretched about a projecting T-shaped arm extending from the center portion of the edge of jaw 33 and may be replaced.

Each jaw 32, 33 is made of a light tough cast plastic material and they are mutually pivoted about the common pivot pin 40' about which a bias spring (not shown) is placed to urge the two jaws 32, 33 together at the gripping edge of the jaws. The paper 15 is abutted up against the two separated stops 49L and 49R at the opposite ends of jaw 32 between which the jaw member 33 is interleaved on pivot pin 40'. Thus, lever arm 37 may be used to program selective opening and closing of the gripping jaws for entry and release of paper 15 by means of a mating cam riding on roller 34 for example.

With the separated stops 49 and the gripping means 90, 91 centered therebetween, the edge of the paper 15 self aligns and is not subject to gripping and transport in non-aligned skewed or slanted position.

The jaw 32 presents a flat platform, which is oriented at an angle $\alpha$ from the plane of chain 31 parallel to the transport track 17. This causes the papers 15 to be normally disposed in natural position for shingling without imposing any bending forces that tend to open the jaws or mislocate the precision mated paper position during transit.

INDUSTRIAL APPLICATION

Light weight tractor assemblies for gripping, transporting and releasing newspapers and like paper sheet products are rolled along tracks about a cyclic closed in plant conveyance path to pick-up and deliver from station to station in precise timing and orientation the papers in shingled overlap manner for high speed system processing such as printing, addressing, counting, bundling, etc.

I claim:

1. A transport carriage for conveying newspapers or like paper products between processing stations with precision timing and orientation over a path defined by a track consisting of a single piece U-shaped channel having two inwardly disposed flanges at the mouth of the U adapted to receive and confine guide rollers riding thereinside, comprising in combination, two jaw members pivoted about a common pivot axis and presenting gripping means with a friction surface disposed between the jaws for gripping between gripping edges on the two jaws and seating means for holding the paper products in alignment against a stop surface adjacent the axis for transport by pulling along said path with the leading paper edges in parallel position, four guide rollers positioned with two rollers each on opposite sides of the carriage midpoint and coupled to one jaw for confinement inside of said U-shaped channel to ride thereinside and thereby said track, and programmable pivot means for selectively opening and closing the jaws for entry, alignment, gripping and releasing the paper products for transport between selected stations along the track to pull the leading edges of the products.

2. The carriage defined in claim 1 wherein the carriage is conveyed by attachment at precisely spaced distances from preceding and following carriages to a moving link chain, including means for coupling the carriage to the chain by means of a link with an integral arm extending therefrom and removably fastenable to the carriage.

3. The carriage defined in claim 1 wherein one jaw is T shaped thereby defining thereon a centrally located extension arm extending from the gripping edge, and the gripping means comprises a removable rubber-like O-ring mounted on said extension arm.

4. The carriage defined in claim 3 wherein the O-ring is centrally mounted along a longitudinally disposed gripper jaw and said stop surface comprises two stop members disposed on either side of the O-ring for abutting of the paper product thereagainst in aligned position when gripped by said jaws.

5. The carriage defined in claim 1 with jaw structure presenting a flat platform surface against which the paper product rests with folded edge disposed inwardly toward said pivot axis and means orienting the platform surface at an angle with respect to the travel path axis of the carriage to disposed the trailing edge of the products away from the path with the angle chosen to release the products in natural position for attaining a shingled array one on top of the other with the folded edge forward when released downwardly by opening the jaws.

6. The carriage defined in claim 1 including further roller means disposed perpendicularly on the one said jaw with the other four rollers in a position outwardly disposed toward the mouth of the U-shape of the channel to ride on said U-shaped channel.

* * * * *